US008167379B1

(12) United States Patent
Lee

(10) Patent No.: US 8,167,379 B1
(45) Date of Patent: May 1, 2012

(54) ROUND TOOTHBRUSH BRISTLES AND PROCESSING METHOD THEREOF

(75) Inventor: Han-Ki Lee, Suwon (KR)

(73) Assignee: Tae Sang Chung, Tenafly, NJ (US)

( * ) Notice: Subject to any disclaimer, the term of this patent is extended or adjusted under 35 U.S.C. 154(b) by 0 days.

(21) Appl. No.: 13/377,443

(22) PCT Filed: Aug. 26, 2009

(86) PCT No.: PCT/KR2009/004758

§ 371 (c)(1),
(2), (4) Date: Dec. 9, 2011

(87) PCT Pub. No.: WO2010/143779

PCT Pub. Date: Dec. 16, 2010

(30) Foreign Application Priority Data

Jun. 12, 2009 (KR) ..... 10-2009-0052323

(51) Int. Cl.
*A46D 1/04* (2006.01)

(52) U.S. Cl. ..... 300/21

(58) Field of Classification Search ..... 300/21
See application file for complete search history.

(56) References Cited

U.S. PATENT DOCUMENTS

| | | | | |
|---|---|---|---|---|
| 3,830,547 | A * | 8/1974 | Awazi et al. | 300/21 |
| 7,448,693 | B2 * | 11/2008 | Kwon et al. | 300/21 |
| 2008/0100126 | A1 * | 5/2008 | Kwon et al. | 300/21 |
| 2008/0289131 | A1 * | 11/2008 | Kwon et al. | 15/207.2 |

FOREIGN PATENT DOCUMENTS

| | | | |
|---|---|---|---|
| JP | 1-313005 | * | 12/1989 |
| JP | 10-057149 | A | 3/1998 |
| JP | 2000-270928 | A | 10/2000 |
| JP | 2002-262940 | * | 9/2002 |
| JP | 2002-330824 | * | 11/2002 |
| KR | 10-2006-0107231 | A | 10/2006 |
| KR | 10-2009-0107166 | A | 10/2009 |

* cited by examiner

*Primary Examiner* — Mark Spisich
(74) *Attorney, Agent, or Firm* — The Nath Law Group; Jerald L. Meyer; Mihsuhn Koh

(57) ABSTRACT

Disclosed herein is a method of processing rounded toothbrush bristles using synthetic bristles. The method includes cutting one end of a filament bundle of synthetic bristles, mechanically polishing the cut end of the filament bundle of synthetic bristles, heat treating the polished end of the filament bundle of synthetic bristles, and caustisizing the heat-treated end of the filament bundle of synthetic bristles into a round shape. In this method, at least one end of the toothbrush bristle is softly rounded to protect gum damage due to irritation of the one end of the toothbrush bristle and to provide a gum massaging effect for healthy gum with the rounded end of the toothbrush bristle.

4 Claims, 2 Drawing Sheets

ROUND TOOTHBRUSH BRISTLES AND PROCESSING METHOD THEREOF

CROSS-REFERENCE

This is a National Phase Application filed under 35 U.S.C. 371 as a national stage of PCT/KR2009/004758, filed on Aug. 26, 2009, an application claiming the benefit of priority to Korean Patent Application No. 10-2009-0052323, filed Jun. 12, 2009, the content of each of which is hereby incorporated by reference in its entirety.

BACKGROUND

1. Field

The present subject matter relates to round toothbrush bristles and a processing method thereof. In particular, the present subject matter relates to round toothbrush bristles and a processing method thereof to protect gum damage due to irritation by the one end of the toothbrush bristle and to provide a gum massaging effect for improving gum health.

2. Related Art

A variety of fine bristle toothbrushes are available on the market. FIG. 1 shows a conventional fine bristle toothbrush, in which some bristles are processed to have a tapered tip as shown in (A) and others are cut to have a blunt end as shown in (B).

In fine bristle toothbrushes, synthetic bristles for toothbrush bristles are cut to a predetermined length, in which one end of the bristle is processed to have a finely tapered tip by caustisizing (see FIG. 1(A)), and the other end thereof remains rough without additional processing (see FIG. 1(B)). Then, the bristles are folded at the middle thereof and embedded into a head of the toothbrush.

As a result, part (A) formed as a fine bristle is good for tooth health since it is easy to enter a gap between the tooth and the gum and remove foreign substances. However, since part (B) is made of the same synthetic bristle and remains rough without additional processing after cutting, part (B) is in a damaged state due to cutting.

When such a fine bristle toothbrush is used for a predetermined period of time, while part (A) can remove foreign substance, part (B) continues to irritate the gum, causing gum damage.

Therefore, there has been a need for a method of processing one end of a fine bristle toothbrush to not be rough so as to prevent gum damage, as well as a need for tooth brush bristles prepared by the processing.

SUMMARY

The present subject matter provides a round toothbrush bristle and a processing method thereof, in which at least one end of the toothbrush bristle is softly rounded to protect gum damage due to irritation of the one end of the toothbrush bristle and to provide a gum massaging effect for healthy gums with the rounded end of the toothbrush bristle.

Accordingly, one aspect the present subject matter provides a method of processing toothbrush bristles made of synthetic bristles for obtaining round-shaped toothbrush bristles comprising: cutting one end of a filament bundle of synthetic bristles; mechanically polishing the cut end of the filament bundle of synthetic bristles; heat treating the polished end of the filament bundle of synthetic bristles; and caustisizing the heat-treated end of the filament bundle of synthetic bristles into a round shape. Another aspect of the present subject matter is to provide tooth brush bristles made of synthetic bristles and having at least one end thereof round shaped by caustisizing. These toothbrush bristles, having at least one end softly rounded, can protect gum damage due to irritation by the one end of the toothbrush bristle and to provide a gum massaging effect for improving gum health.

DETAILED DESCRIPTION OF THE PREFERRED EMBODIMENT

One aspect the present subject matter is a method of processing toothbrush bristles using synthetic bristles for obtaining round-shaped toothbrush bristles comprising: cutting one end of a filament bundle of synthetic bristles; mechanically polishing the cut end of the filament bundle of synthetic bristles; heat treating the polished end of the filament bundle of synthetic bristles; and caustisizing the heat-treated end of the filament bundle of synthetic bristles into a round shape.

In one embodiment, the synthetic bristles may comprise a polyethylene terephthalate resin or a polybutylene terephthalate resin. In another embodiment, the one end of the filament bundle of synthetic bristles, in causticizing, may be dipped to a depth of 3 mm or less in an alkali solution.

Another aspect of the present subject matter is to provide tooth brush bristles made of synthetic bristles and having at least one end thereof round shaped by caustisizing. These toothbrush bristles having at least one end softly rounded can protect gum damage due to irritation by the one end of the toothbrush bristle and to provide a gum massaging effect for improving gum health.

Exemplary embodiments of the present subject matter are described in the following with reference to the accompanying drawings.

Figure 1:
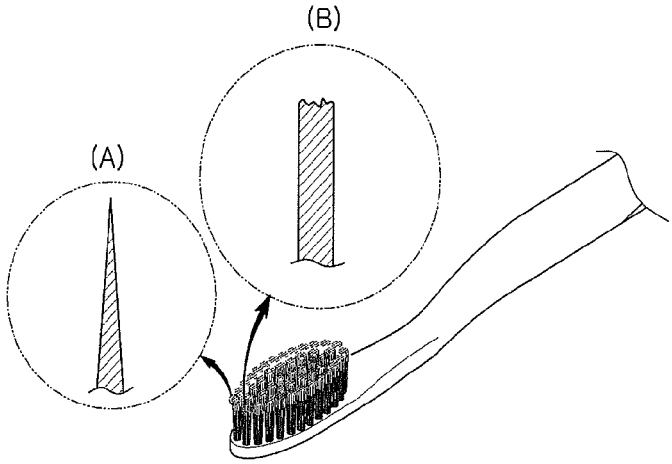
FIG. 1 is a view of a conventional fine bristle toothbrush.
Figure 2:
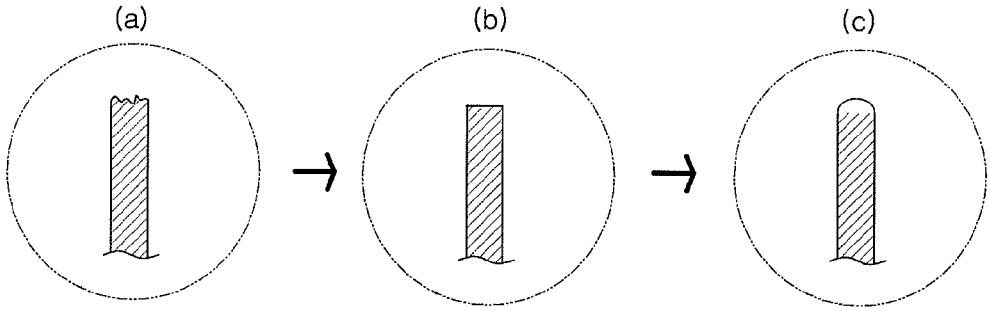
FIG. 2 is a schematic flow diagram of a method of processing one end of a toothbrush bristle.
Figure 3:
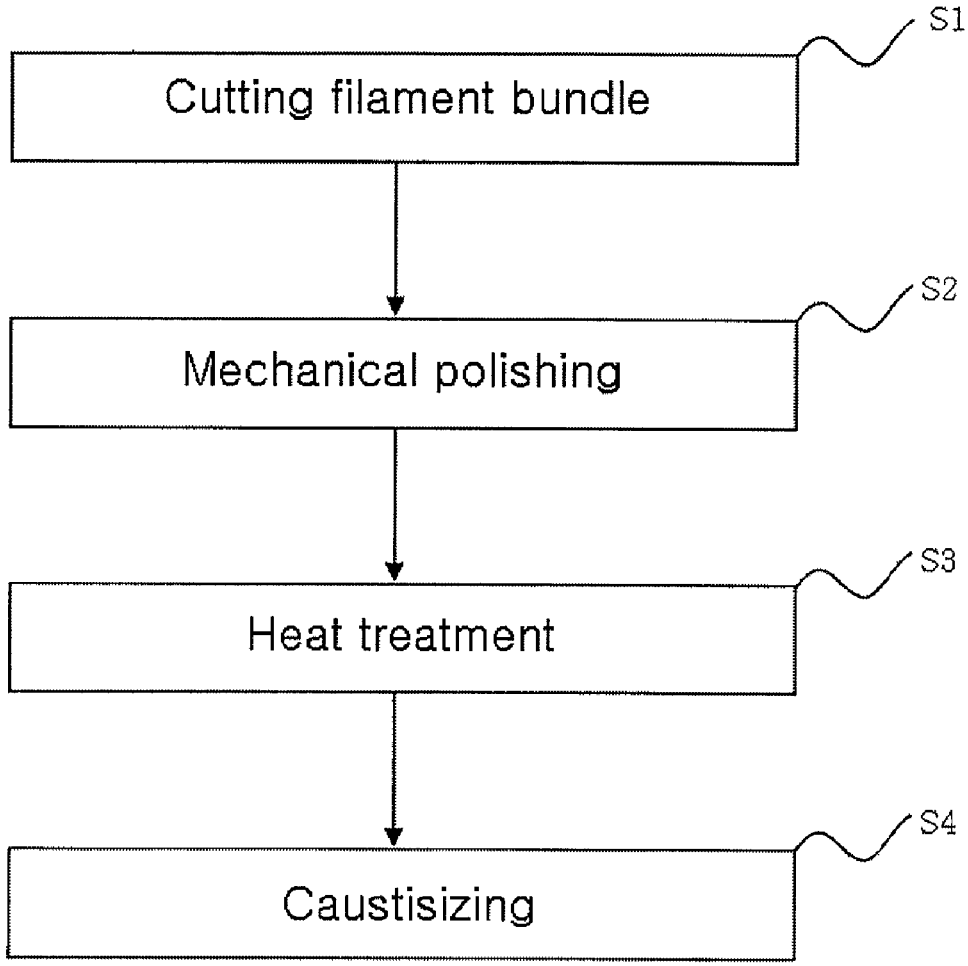
FIG. 3 is a flowchart of a method of processing toothbrush bristles according to an exemplary embodiment of the present subject matter.

FIG. 2 is a schematic flow diagram of a method of processing one end of a toothbrush bristle, and FIG. 3 is a flowchart of a method of processing toothbrush bristles according to an exemplary embodiment of the present subject matter.

Referring to FIG. 2, the one end of the toothbrush bristle is subjected to mechanical polishing and heat treatment and is thus changed from a roughly cut shape (a) to a smoothly even shape (b). Then, the one end of the toothbrush bristle is subjected to a caustisizing process and finally has a rounded shape (c).

In this embodiment, toothbrush bristles are synthetic bristles made of a synthetic resin, such as, polyethylene terephthalate or polybutylene terephthalate.

Referring to FIGS. 2 and 3, the one end of the toothbrush bristle is processed as follows.

First, a filament bundle made of polyethylene terephthalate or polybutylene terephthalate is cut to a predetermined length (in S1).

If the filament bundle having a roughly cut end (see (a) of FIG. 2) is directly used as the toothbrush bristles, the rough end of the bristle will irritate the gums. With continued use of the toothbrush bristles having such rough ends, the gums can be damaged. Accordingly, the rough end of the toothbrush bristle is primarily subjected to mechanical polishing (in S2). The cut filament bundles are sequentially passed through a polishing machine such that the uneven rough ends of the toothbrush bristles as shown in FIG. 2(*a*) are primarily arranged evenly.

Then, the filament bundle is passed through a heat-treatment machine in sequence to perform heat treatment of the polished end of the filament bundle (in S3), so that the roughly cut end of the filament bundle as shown in FIG. 2(*b*) becomes smooth. Here, the one end of the filament bundle may be exposed to heat at a temperature of about 200 to 600° C. for 0.5 to 5 seconds.

Then, the one end of the filament bundle as shown in FIG. 2(*b*) is rounded by caustisizing (in S4). Caustisizing is achieved by dipping the filament bundle into a 40 to 50% alkali solution at 105 to 120° C. for 30 to 90 minutes. In this process, the alkali solution may be caustic soda.

Further, the one end of the filament bundle may be rounded or further finely tapered depending on the length of the filament bundle dipped into the alkali solution. Thus, to form a rounded end of the filament bundle, the one end of the filament bundle may be dipped to a depth of about 3 mm or less in the alkali solution.

With these processes, one end of the toothbrush bristle may be processed to have a rounded shape. The rounded end of the toothbrush bristle prevents gum damage caused by continued irritation of the gums and provides a gum massaging effect for improving gum health.

Although the toothbrush bristle is illustrated as being processed only at one end thereof to have a rounded end in the exemplary embodiment described above, the present subject matter is not limited thereto. Alternatively, the toothbrush bristle may be processed on the opposite end of the one end processed to have rounded opposite end and may then be embedded at the middle of the bristle in a toothbrush head, as needed.

Although some exemplary embodiments have been illustrated and described, it will be appreciated by those skilled in the art that modifications and changes may be made without departing from the scope and spirit of the invention. Therefore, the scope of the present subject matter is limited only by the appended claims and equivalents thereof.

The invention claimed is:

1. A method of processing toothbrush bristles made of synthetic bristles for obtaining round-shaped toothbrush bristles, comprising:

cutting one end of a filament bundle of synthetic bristles;

mechanically polishing the cut end of the filament bundle of synthetic bristles;

heat treating the polished end of the filament bundle of synthetic bristles; and caustisizing the heat-treated end of the filament bundle of synthetic bristles into a round shape.

2. The method of claim 1, wherein the synthetic bristles comprise a polyethylene terephthalate resin or a polybutylene terephthalate resin.

3. The method of claim 1, wherein the caustisizing is performed using caustic soda.

4. The method of claim 1, wherein in the caustisizing, the one end of the filament bundle of the synthetic bristles is dipped to a depth of 3 mm or less in a alkali solution.

* * * * *